US009579896B2

(12) United States Patent
Imahashi et al.

(10) Patent No.: US 9,579,896 B2
(45) Date of Patent: Feb. 28, 2017

(54) LIQUID EJECTING APPARATUS AND LIQUID EJECTING HEAD

(71) Applicant: CANON KABUSHIKI KAISHA, Tokyo (JP)

(72) Inventors: Yusuke Imahashi, Kawasaki (JP); Hiroshi Arimizu, Kawasaki (JP); Nobuhito Yamaguchi, Inagi (JP); Arihito Miyakoshi, Tokyo (JP); Yoshinori Itoh, Tokyo (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/073,764

(22) Filed: Mar. 18, 2016

(65) Prior Publication Data

US 2016/0271950 A1 Sep. 22, 2016

(30) Foreign Application Priority Data

Mar. 19, 2015 (JP) ..... 2015-056212

(51) Int. Cl.
*B41J 2/165* (2006.01)
*B41J 2/17* (2006.01)

(52) U.S. Cl.
CPC ..... *B41J 2/165* (2013.01); *B41J 2/16585* (2013.01); *B41J 2/1714* (2013.01); *B41J 2/16517* (2013.01)

(58) Field of Classification Search
None
See application file for complete search history.

(56) References Cited

U.S. PATENT DOCUMENTS

| | | | | |
|---|---|---|---|---|
| 9,199,472 | B2 | 12/2015 | Ishida et al. | |
| 9,358,793 | B2 | 6/2016 | Arimizu et al. | |
| 9,381,746 | B2 | 7/2016 | Miyakoshi et al. | |
| 2002/0158937 | A1 | 10/2002 | Pietrzyk et al. | |
| 2006/0238561 | A1 | 10/2006 | Carcia et al. | |
| 2011/0109693 | A1* | 5/2011 | Ohnishi | B41J 2/18 347/34 |
| 2016/0031218 | A1 | 2/2016 | Ishida et al. | |

FOREIGN PATENT DOCUMENTS

| | | | |
|---|---|---|---|
| JP | 2004-330446 | A | 11/2004 |
| JP | 2009-220499 | A | 10/2009 |

OTHER PUBLICATIONS

Search Report issued in corresponding European Patent Application No. 16160189.3. dated Sep. 15, 2016.

* cited by examiner

*Primary Examiner* — Lisa M Solomon
(74) *Attorney, Agent, or Firm* — Fitzpatrick, Cella, Harper & Scinto

(57) ABSTRACT

There is provided a liquid ejecting apparatus and a liquid ejecting head in which mist does not close an ejection port so as to prevent any degradation of the reliability of ejection. In view of this, a ceiling surface is formed between a mist recovering unit and a gas blowing unit in a mist recovering mechanism, thus forming a recess. Inside of the recess are formed a suction port of the mist recovering unit and a gas blowing port of the gas blowing unit.

20 Claims, 12 Drawing Sheets

LIQUID EJECTING APPARATUS AND LIQUID EJECTING HEAD

BACKGROUND OF THE INVENTION

Field of the Invention

The present invention relates to a liquid ejecting apparatus that is equipped with the function of recovering mist generated together with ejected liquid droplets, and a liquid ejecting head.

Description of the Related Art

In a liquid ejecting apparatus for ejecting liquid through an ejection port formed at a liquid ejecting head, fine liquid droplets called satellite or mist other than liquid droplets (main droplets) are ejected together with the main droplets to be ejected in ejecting the liquid droplets. Such fine liquid droplets (hereinafter also referred to as mist) adhere to various portions inside of the apparatus, such as an ejection port surface (hereinafter also referred to as a face) at which ejection ports of the liquid ejecting head are formed. Particularly, in a case where fine liquid droplets adhere to the face, mist is coalesced into a large liquid droplet that closes the ejection port, thereby degrading the reliability of ejection. Alternatively, in a case where fine liquid droplets adhere to a light receiving surface or a scale of a position sensor for the liquid ejecting head disposed inside of the apparatus, the liquid droplets cannot be ejected to accurate positions.

In view of the above, the specification of U.S. Patent Laid-Open No. 2006/0238561 discloses a method for recovering an airflow including mist by arranging a liquid ejecting head, a blowing port, through which an airflow is blown, and a suction port, through which mist is sucked at a substantially equal interval from a print medium.

However, even in a case where the liquid ejecting head, the blowing port, through which the airflow is blown, and the suction port, through which the mist is sucked, are arranged at a substantially equal interval from the print medium, as disclosed in the specification of U.S. Patent Laid-Open No. 2006/0238561, the mist that is diffused cannot be sufficiently recovered through the suction port. As a consequence, the mist adheres to the liquid ejecting head, so as to close the ejection port, thereby degrading the reliability of ejection.

SUMMARY OF THE INVENTION

Therefore, the present invention is to provide a liquid ejecting apparatus in which mist does not close an ejection port so as to prevent any degradation of the reliability of ejection, and a liquid ejecting head.

A liquid ejecting apparatus according to the present invention including an ejecting unit configured to eject liquid to a medium through an ejection port and a moving unit configured to make a relative movement between the ejecting unit and the medium. The liquid ejecting apparatus includes: a recovering unit that is disposed downstream of the ejecting unit with respect to the relative movement of the medium and at a position at which the recovering unit can face the medium, the recovering unit being capable of recovering mist generated together with a main droplet of liquid ejected by the ejecting unit. The recovering unit includes: a recovering portion disposed upstream with respect to the relative movement of the medium so as to recover the mist; and a blowing port that is disposed downstream of the recovering portion with respect to the relative movement of the medium and can blow gas. At the recovering unit, a recess having a ceiling surface capable of facing the medium is formed between the recovering portion and the blowing port at a distance longer than a distance between an ejection port surface and the medium in a case where the ejection port surface having the ejection port faces the medium. The recovering portion and the blowing port are disposed inside of the recess.

The present invention can provide the liquid ejecting apparatus in which the mist does not close the ejection port so as to prevent any degradation of the reliability of ejection, and the liquid ejecting head.

Further features of the present invention will become apparent from the following description of exemplary embodiments (with reference to the attached drawings).

DESCRIPTION OF THE EMBODIMENTS

First Embodiment

Figure 1A:
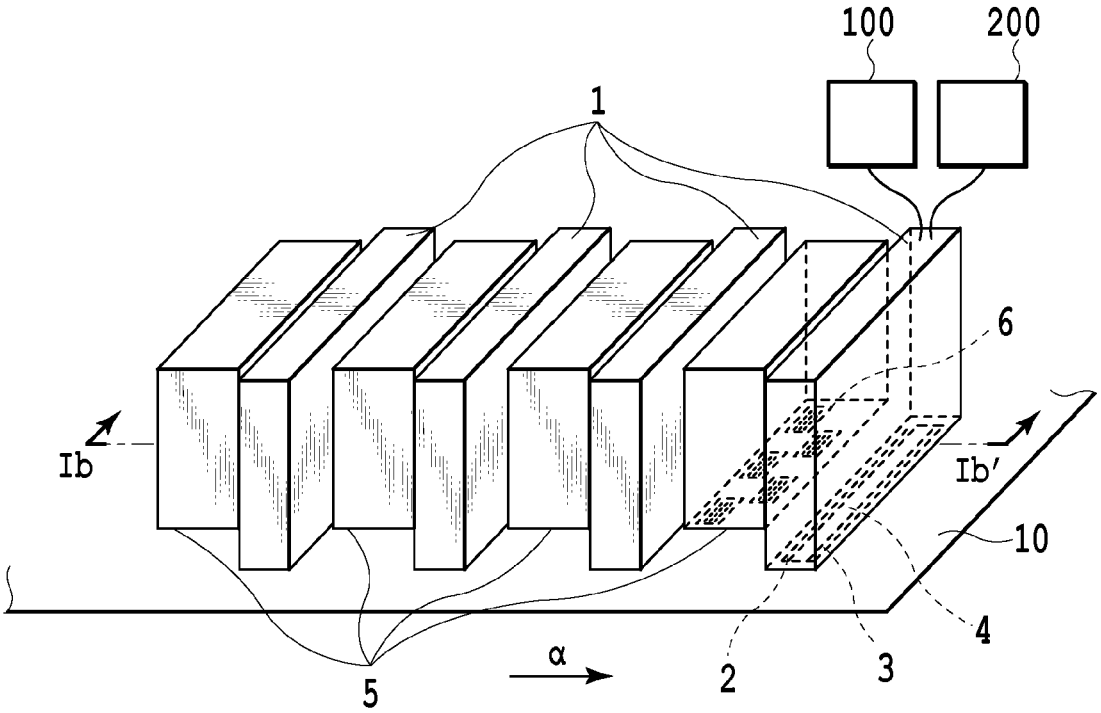
FIG. 1A is a view showing a liquid ejecting head and a mist recovering mechanism.
Figure 1B:
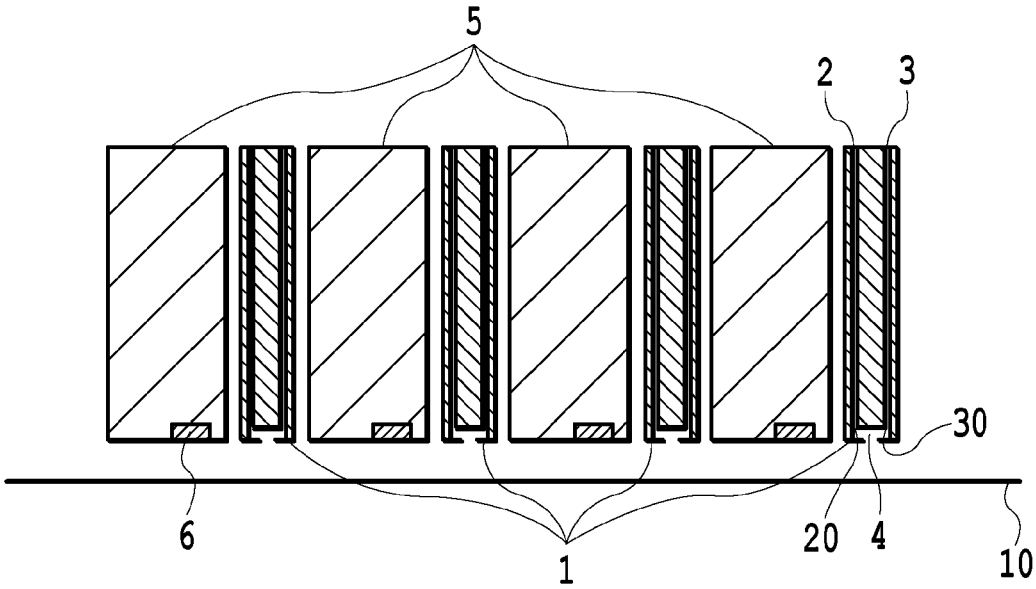
FIG. 1B is another view showing the liquid ejecting head and the mist recovering mechanism.

FIGS. 1A and 1B are views showing a liquid ejecting head and a mist recovering mechanism in a liquid ejecting apparatus, to which the present invention is applicable. FIG. 1A is a perspective view showing a liquid ejecting head 5 and a mist recovering mechanism 1; and FIG. 1B is a cross-sectional view taken along a line Ib-Ib' of FIG. 1A. Four liquid ejecting heads 5 are provided in a manner corresponding to four colors. The mist recovering mechanisms 1 are provided in a manner corresponding to the liquid ejecting heads 5, respectively. Each of the mist recovering mechanisms 1 is connected to a sucking device 100 and a blowing device 200. Incidentally, the mist recovering mechanism 1 may be equipped with the same functions of the sucking device 100 and the blowing device 200.

In ejecting liquid to a medium 10, the liquid ejecting head 5 is moved relatively to the medium 10 at a position facing a print element substrate 6. At this time, an airflow flowing in a direction indicated by an arrow a is produced between the liquid ejecting head 5 and the medium 10. Mist produced together with main droplets of the liquid ejected from the print element substrate 6 also is moved on the airflow. The mist recovering mechanism 1 is disposed downstream of the airflow with respect to the liquid ejecting head 5. A mist recovering unit 2 and a gas blowing unit 3 are disposed in this order from upstream of the airflow to downstream thereof.

Moreover, a recess 4 having a ceiling surface 40 at a position more apart from the medium 10 than an ejection port surface, at which an ejection port of the liquid ejecting head 5 is formed, is formed between the mist recovering unit 2 and the gas blowing unit 3 in the mist recovering mechanism 1. In the present embodiment, the mist recovering unit 2 sucks and recovers mist 9 through a suction port 20 (i.e., a recovering unit) by sucking the airflow under a negative pressure, and furthermore, the gas blowing unit 3 can blow gas supplied by a pump, not shown, through a blowing port 30. The suction port 20, through which the airflow is sucked, and the blowing port 30, through which gas is blown, are formed inside of the recess 4, and therefore, they can face the medium 10.

Figure 2A:
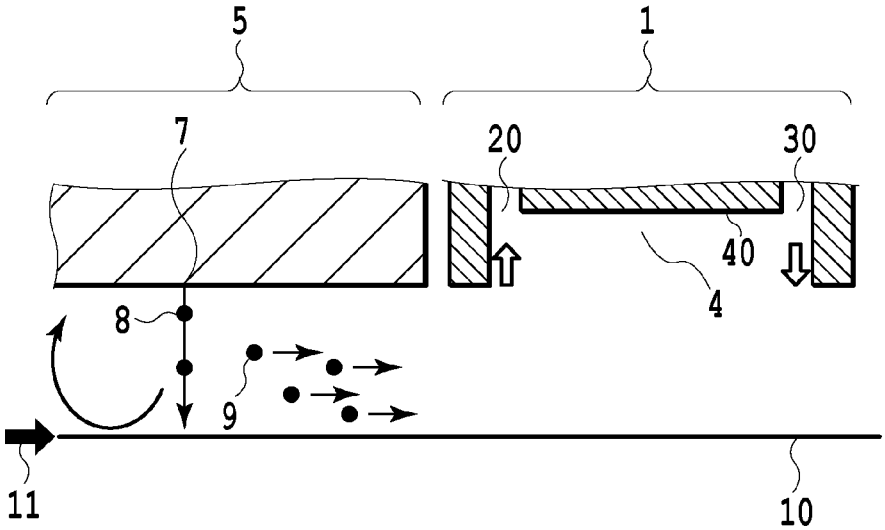
FIG. 2A is a view showing a state in which the mist recovering mechanism recovers mist.
Figure 2B:
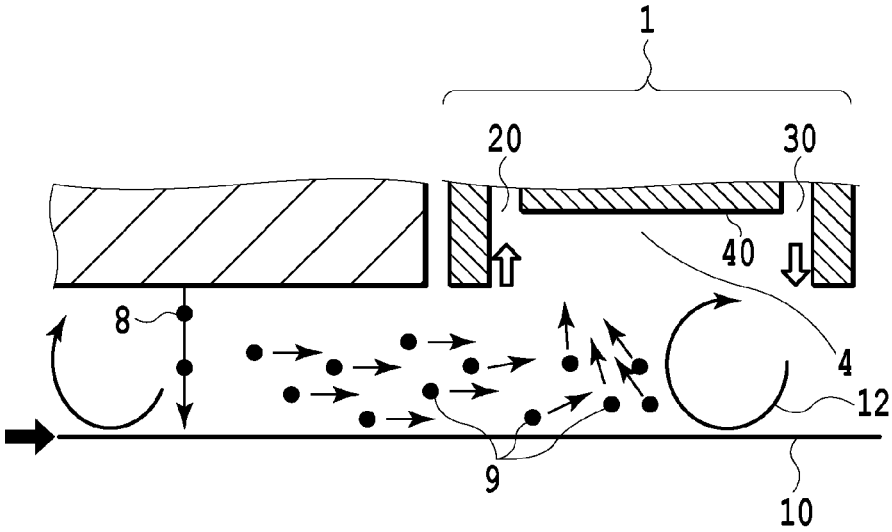
FIG. 2B is another view showing a state in which the mist recovering mechanism recovers mist.
Figure 2C:
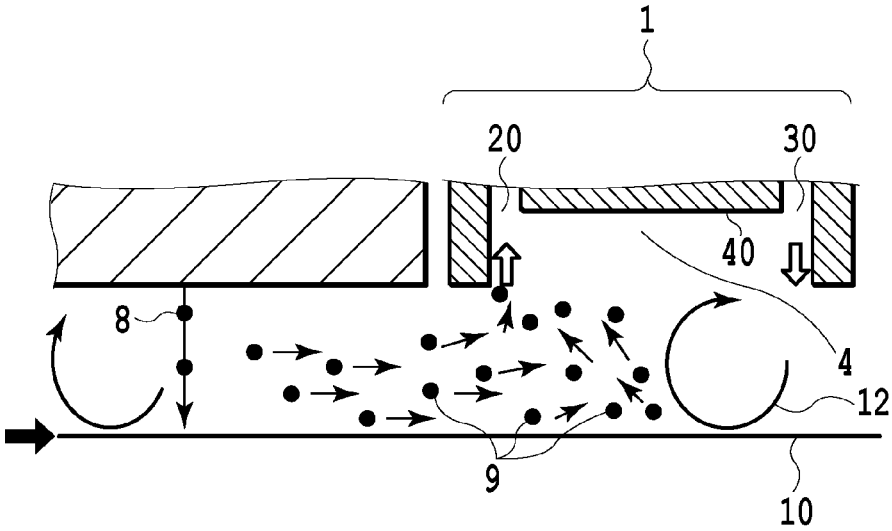
FIG. 2C is a further view showing a state in which the mist recovering mechanism recovers mist.

FIGS. 2A to 2C are views showing states in which the mist recovering mechanism 1 recovers the mist in the present embodiment. In other words, FIGS. 2A to 2C are schematic cross-sectional views showing the liquid ejecting head 5, the mist recovering mechanism 1, and the medium 10. As shown in FIGS. 2A to 2C, the ceiling surface 40 is formed at a position more apart from the medium 10 than a surface at which an ejection port 7 is formed at the liquid ejecting head 5, thus defining the recess 4. In FIG. 2A, the mist 9 generated together with a main droplet 8 of liquid ejected through the ejection port at the liquid ejecting head 5 is moved downstream on an airflow produced by the relative movement between the liquid ejecting head 5 and the medium 10.

In FIG. 2B, the mist 9 moved under the mist recovering mechanism 1 disposed downstream is swirled up by a vortex 12 produced by blowing gas through the gas blowing port 30 formed at the gas blowing unit 3, and thus, a further downstream movement of the mist 9 can be suppressed. Thereafter, in FIG. 2C, the swirled mist 9 is introduced into the recess 4, where the mist 9 can be recovered through the suction port 20 on the airflow flowing toward the suction portion 20, produced by the suction by the mist recovering unit 2. The above is the outline of the unit for recovering the mist 9 in the present embodiment.

In this manner, according to the present invention, the mist 9 is recovered by not only the suction by the mist recovering unit 2 but also the gas blowing by the gas blowing unit 3.

Figure 3:
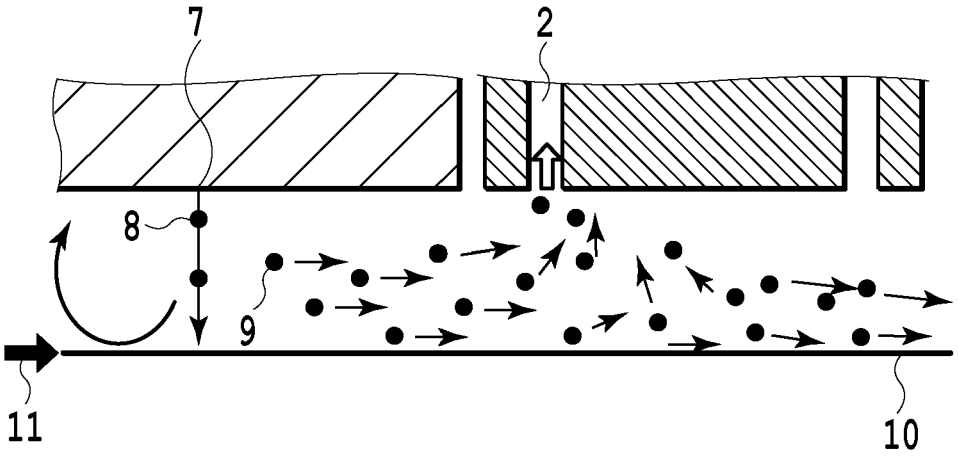
FIG. 3 is a view showing a state in which only sucking recovers mist in a comparative example.

FIG. 3 is a view showing a state in which only sucking by the mist recovering unit recovers mist in a comparative example. In a case where mist generated by ejecting liquid is recovered by only sucking, no vortex is produced by a gas blowing unit, and therefore, there is no effect of suppressing a downstream flow of mist that cannot be recovered by the mist recovering unit. As a result, the mist that cannot be sufficiently recovered by the mist recovering unit unfavorably flows downstream.

Moreover, in order to prevent the mist from flowing downstream, an increase in quantity of gas sucked by the mist recovering unit is conceived. However, in this case, the airflow toward the suction port becomes strong. Not only the mist but also the ejected main droplet are adversely influenced by the airflow, and therefore, the main droplet cannot be ejected at a desired position.

Specifically, in order to sufficiently recover the mist without any malfunction, not only the mist recovering unit but also the gas blowing unit effectively recover the mist. Moreover, in order to stably recover the mist, it is necessary to stably generate a vortex by the gas blowing unit. According to the present invention, in order to form a space for generating a vortex between the mist recovering unit 2 and the gas blowing unit 3, the recess 4 is defined between the mist recovering mechanism 1 and the gas blowing unit 3, and then, the mist recovering unit 2 and the gas blowing unit 3 are disposed in the recess 4.

Figure 4A:
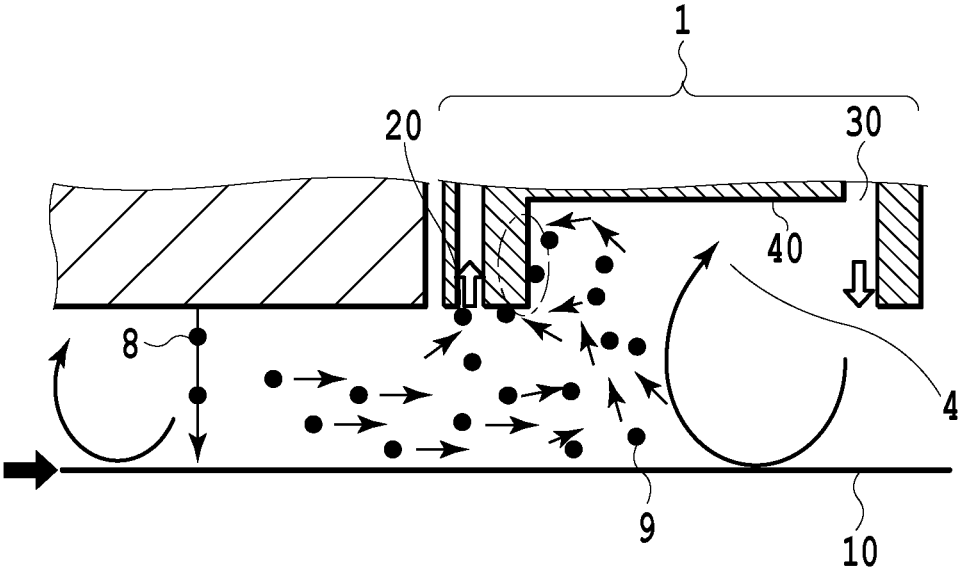
FIG. 4A is a view showing a configuration in which the positions of a mist recovering unit and a gas blowing unit are changed.
Figure 4B:
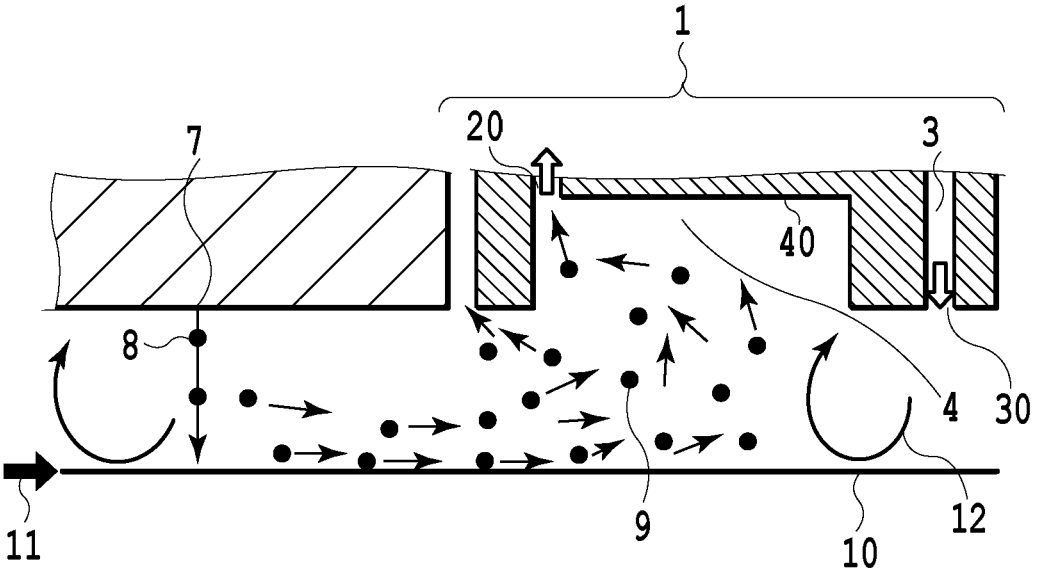
FIG. 4B is another view showing a configuration in which the positions of the mist recovering unit and the gas blowing unit are changed.

FIGS. 4A and 4B are schematic views showing states in which the positions of the mist recovering unit 2 and the gas blowing unit 3 are varied to recover the mist 9 in order to verify the positions of the mist recovering unit 2 and the gas blowing unit 3. FIG. 4A is a view showing the suction port 20 of the mist recovering unit 2 formed outside of the recess 4; and FIG. 4B is a view showing the blowing port 30 of the gas blowing unit 3 formed outside of the recess 4.

In a case where the suction port 20 of the mist recovering unit 2 is formed outside of the recess 4, a vortex is produced inside of the recess 4 by blowing gas, thus swirling, from a sheet, the mist 9 flowing downstream. However, a large quantity of swirled mist 9 retains in the recess 4, so that the mist 9 adheres to the inside of the mist recovering mechanism 1. Moreover, although a part of the mist 9 is carried to the mist recovering unit 2 on the airflow produced by suction by the mist recovering unit 2 outside of the recess 4, it is a slight quantity.

In view of the above, in order to stably recover the mist 9, it is necessary to form the suction port 20 of the mist recovering unit 2 within the recess 4.

Moreover, in a case where the blowing port 30 is formed outside of the recess 4, the airflow produced through the blowing port 30 forms the vortex 12 outside of the recess 4. Specifically, the vortex is formed at a portion that is not a space of the recess 4, and therefore, a large vortex cannot be formed. As a consequence, the floating mist 9 cannot be introduced to the suction port 20 of the mist recovering unit 2, and therefore, the mist 9 adheres to the liquid ejecting head 5 or the mist recovering mechanism 1.

In view of the above, in order to form a large vortex by the airflow produced through the gas blowing port and stably recover the mist with high efficiency, the blowing port 30 needs to be formed inside of the recess 4.

In this manner, the recess is defined by forming the ceiling surface between the mist recovering unit and the gas blowing unit in the mist recovering mechanism, and then, the suction port of the mist recovering unit and the gas blowing port of the gas blowing unit are formed within the recess. As a consequence, it is possible to achieve the liquid ejecting apparatus and the liquid ejecting head in which the mist does not close the ejection port so as to prevent any degradation of the reliability of the ejection.

Second Embodiment

A second embodiment according to the present invention will be described below with reference to the attached drawings. The basic configuration of the present embodiment is the same as that of the first embodiment, and therefore, only a characteristic configuration will be explained below.

Figure 5A:
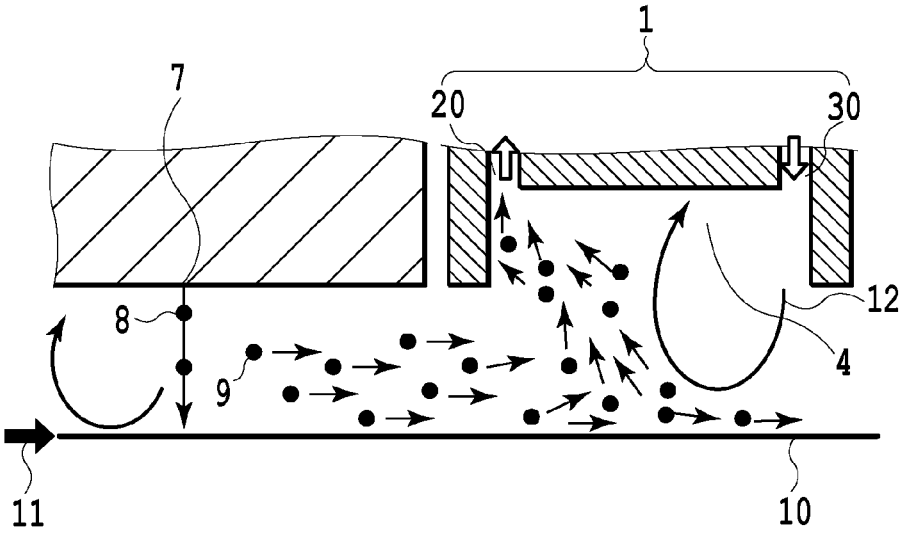
FIG. 5A is a schematic view showing a liquid ejecting head and a mist recovering mechanism.
Figure 5B:
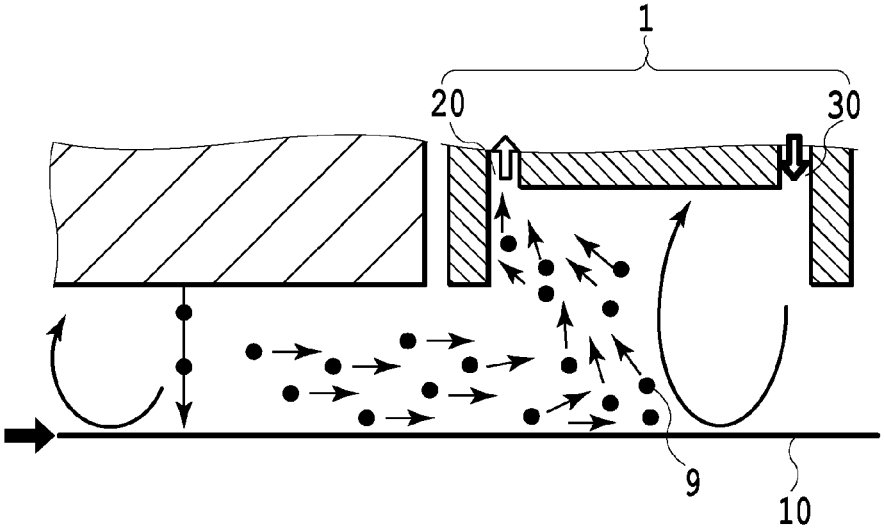
FIG. 5B is another schematic view showing the liquid ejecting head and the mist recovering mechanism.
Figure 5C:
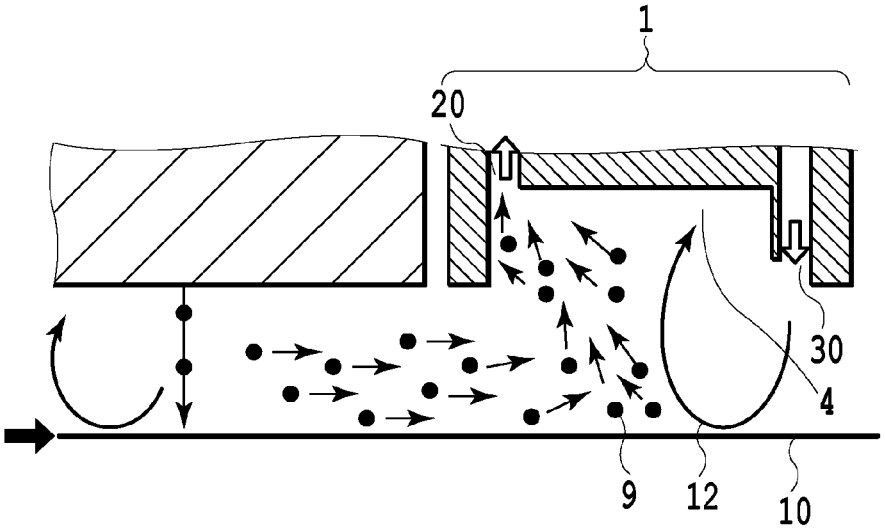
FIG. 5C is a further schematic view showing the liquid ejecting head and the mist recovering mechanism.

FIGS. 5A to 5C are views explanatory of a mist recovering mechanism 1 in the present embodiment, and furthermore, are schematic views showing a liquid ejecting head 5 and the mist recovering mechanism 1. Even if a recess 4 is defined between a mist recovering unit 2 and a gas blowing unit 3 and a suction port 20 and a blowing port 30 are formed within the recess 4, a blown airflow may not reach a medium 10 in a case where the blowing through the blowing port 30 is weak.

In this case, as shown in FIG. 5A, mist 9 may flow downstream through between a vortex 12 and the medium 10. In order to prevent such an outflow, the airflow blown through the gas blowing port 30 needs to reach the medium 10. In view of this, a large quantity of gas needs to be blown through the gas blowing port 30. In this case, as shown in FIG. 5B, an airflow blown through the gas blowing port 30 can reach the medium 10, so as to recover the mist.

However, in a case where the gas blowing quantity is large, the airflow produced between the liquid ejecting head 5 or the mist recovering mechanism 1 and the medium 10 is easily disturbed, resulting in an unstable airflow. In a case where the disturbance of the airflow is large, the mist 9 adheres to the liquid ejecting head 5 or the mist recovering mechanism 1 or is insufficiently recovered by the mist recovering mechanism 1, and consequently, the mist possibly leaks downstream in a movement direction of the medium 10.

In view of the above, in the present embodiment, as shown in FIG. 5C, the gas blowing port 30 of the gas blowing unit 3 is formed at a position nearer the medium 10 than a ceiling surface 40 of the recess 4. Since the gas blowing port 30 is formed near the medium 10, the airflow is efficiently produced without increasing a gas blowing quantity, so that the airflow produced through the gas blowing port 30 easily reaches the medium 10, thus forming a large vortex 12. Hence, the mist can be stably recovered with higher efficiently.

As described above, the gas blowing port is formed at the position nearer the medium than the ceiling surface of the recess, thus efficiently forming the airflow. As a consequence, it is possible to achieve the liquid ejecting apparatus and the liquid ejecting head in which the mist does not close the ejection port so as to prevent any degradation of the reliability of the ejection.

Third Embodiment

A third embodiment according to the present invention will be described below with reference to the attached drawings. The basic configuration of the present embodiment is the same as that of the first embodiment, and therefore, only a characteristic configuration will be explained below.

Figure 6A:
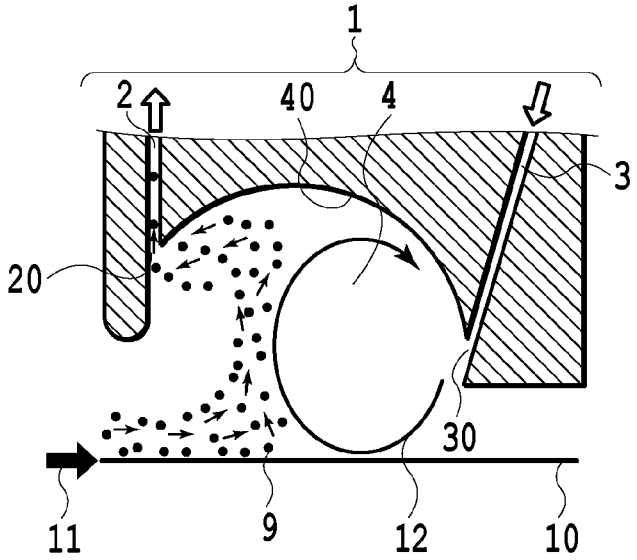
FIG. 6A is a cross-sectional view showing a mist recovering mechanism.
Figure 6B:
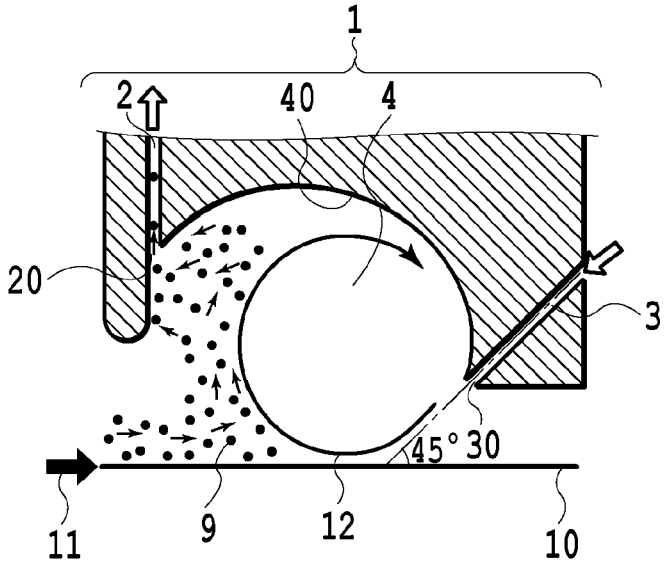
FIG. 6B is another cross-sectional view showing the mist recovering mechanism.
Figure 6C:
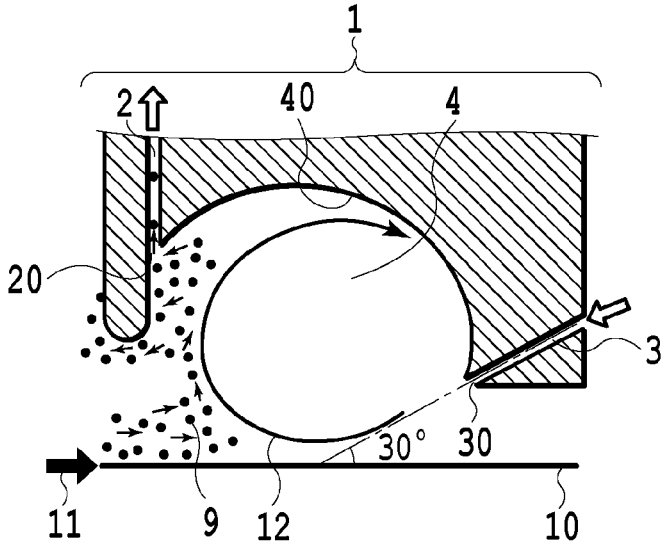
FIG. 6C is a further cross-sectional view showing the mist recovering mechanism.

FIG. 6A is a cross-sectional view showing a mist recovering mechanism 1 in the present embodiment, and FIGS. 6B and 6C are schematic views showing the mist recovering mechanism in a case where a gas blowing angle is varied in the present embodiment. In the mist recovering mechanism 1 in the present embodiment, a ceiling surface 40 of a recess 4 is formed into an arcuate curve.

Since the ceiling surface 40 of the recess 4 is formed into an arcuate curve, an airflow blown through a gas blowing port 30 forms a vortex 12 inside of the recess 4. In a case where the airflow abuts against the ceiling surface 40 to return toward the gas blowing port 30, the airflow is likely to be formed into an arcuate shape, thus more efficiently forming the vortex 12. In this manner, mist 9 can be stably recovered with high efficiency.

In the present embodiment, a gas blowing angle is configured in such a manner as to slantwise blow the airflow toward a medium 10. Since the airflow is slantwise blown through the gas blowing port 30, the vortex 12 of the airflow is more likely to be formed inside of the recess 4, so that the large vortex 12 can be efficiently formed with a fewer quantity of gas. In view of this, it is more desirable to slantwise blow the gas. However, even in a case where the gas is vertically blown toward the medium 10, the vortex 12 is formed inside of the recess 4 so as to recover the mist 9 as long as the gas blowing port 30 is formed inside of the recess 4.

FIG. 6B shows a case where the angle of a gas blowing direction is 45° with respect to the medium 10; and FIG. 6C shows a case where the angle of the gas blowing direction is 30° with respect to the medium 10. As the angle formed by the gas blowing direction and the medium 10 becomes smaller, the horizontal component of a gas blowing rate becomes greater, so that a swirling position by the airflow is shifted toward the liquid ejecting head (i.e., left in FIG. 6B), thereby making it difficult to orient the airflow toward a suction port 20. Therefore, the mist 9 cannot be sufficiently recovered at an angle of 30°. It is desirable that the angle formed by the gas blowing direction and the movement direction of the medium 10 should be 45° or more.

As described above, the ceiling surface of the recess is formed into an arcuate shape, and furthermore, the blowing angle of the gas through the gas blowing port is configured such that the gas is slantwise blown toward the medium. As a consequence, it is possible to achieve the liquid ejecting apparatus and the liquid ejecting head in which the mist does not close the ejection port so as to prevent any degradation of the reliability of the ejection.

Fourth Embodiment

A fourth embodiment according to the present invention will be described below with reference to the attached drawings. The basic configuration of the present embodiment is the same as that of the first embodiment, and therefore, only a characteristic configuration will be explained below.

Figure 7:
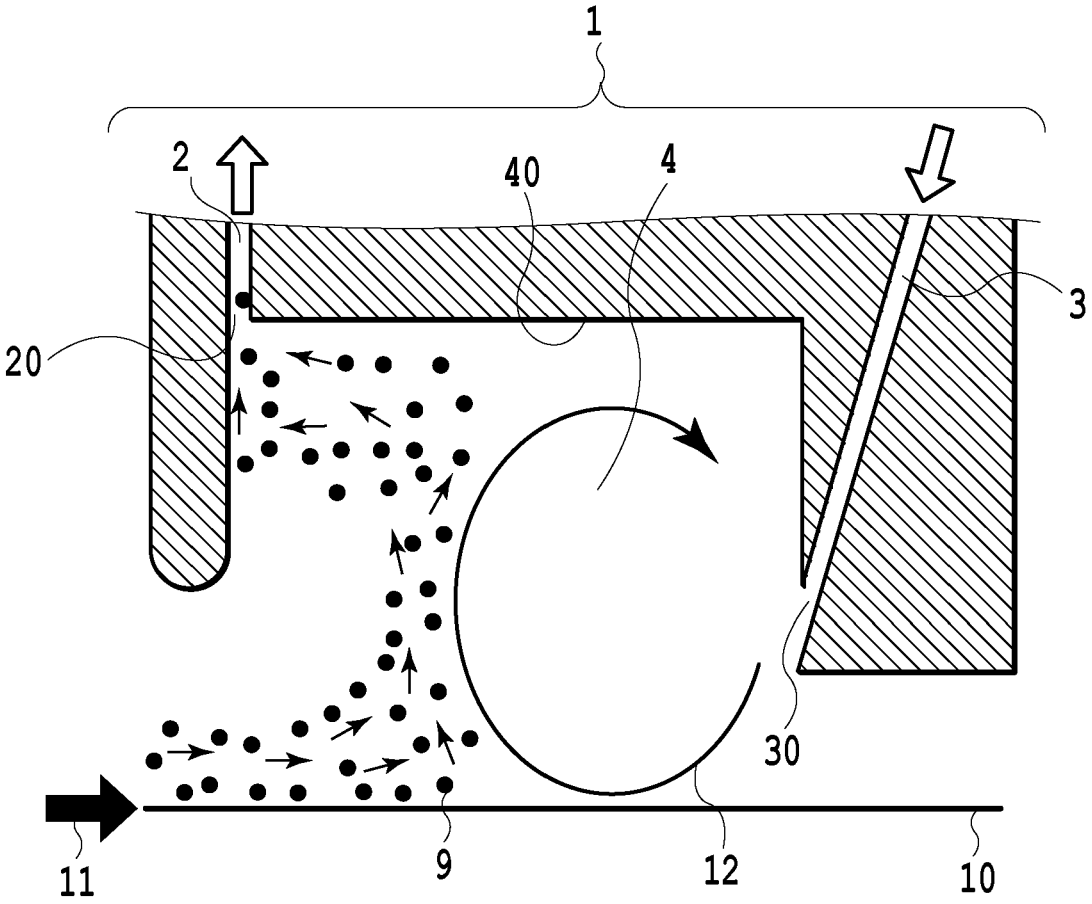
FIG. 7 is a cross-sectional view showing a mist recovering mechanism.

FIG. 7 is a cross-sectional view showing a mist recovering mechanism in the present embodiment. In a mist recovering mechanism 1 in the present embodiment, a ceiling surface 40 of a recess 4 is formed into a plane, and furthermore, a gas blowing angle is configured to be slantwise toward a medium 10.

The size of a vortex 12 in a case where the ceiling surface 40 of the recess 4 is formed into a plane is almost the same as that in a case where the ceiling surface 40 is formed into an arc shown in FIGS. 6A to 6C. It is found that the size of the vortex 12 depends on the height of the ceiling surface 40. In view of this, the ceiling surface 40 of the recess 4 is only required to be higher than an ejection surface, at which an ejection port 7 of a liquid ejecting head 5 is formed. Thus, a large vortex can be stably formed with high efficiency.

As described above, the ceiling surface of the recess is formed into a plane, and furthermore, the gas blowing angle is configured such that the gas is slantwise blown toward the medium. As a consequence, it is possible to achieve the liquid ejecting apparatus and the liquid ejecting head in which the mist does not close the ejection port so as to prevent any degradation of the reliability of the ejection.

Fifth Embodiment

A fifth embodiment according to the present invention will be described below with reference to the attached drawings. The basic configuration of the present embodiment is the same as that of the first embodiment, and therefore, only a characteristic configuration will be explained below.

Figure 8A:
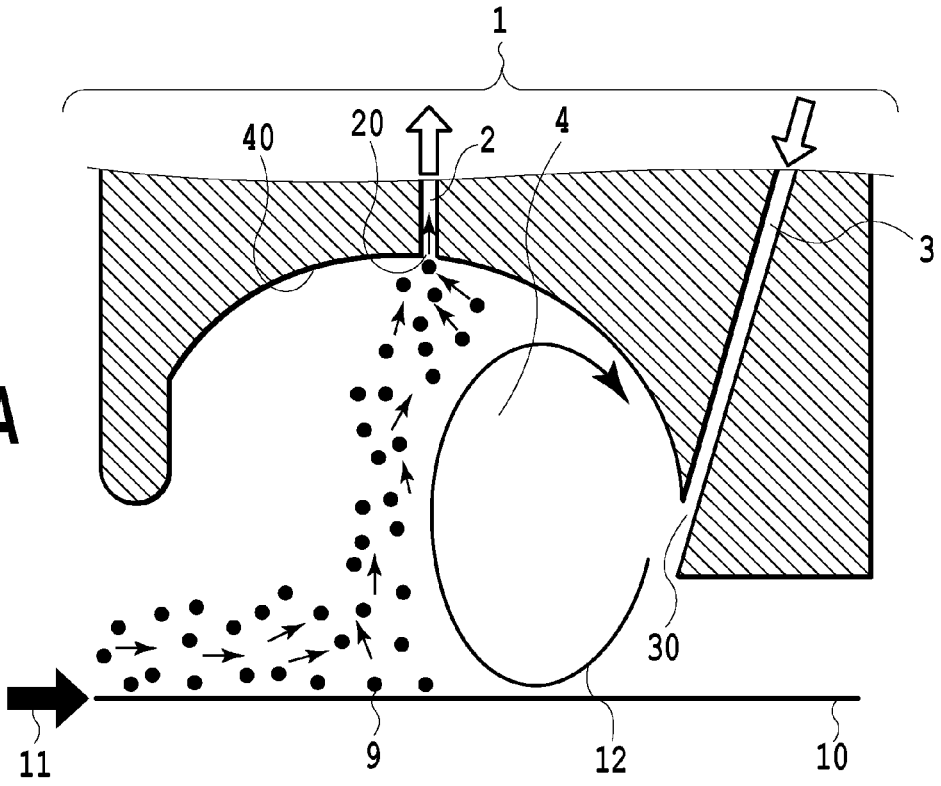
FIG. 8A is a cross-sectional view showing a mist recovering mechanism.
Figure 8B:
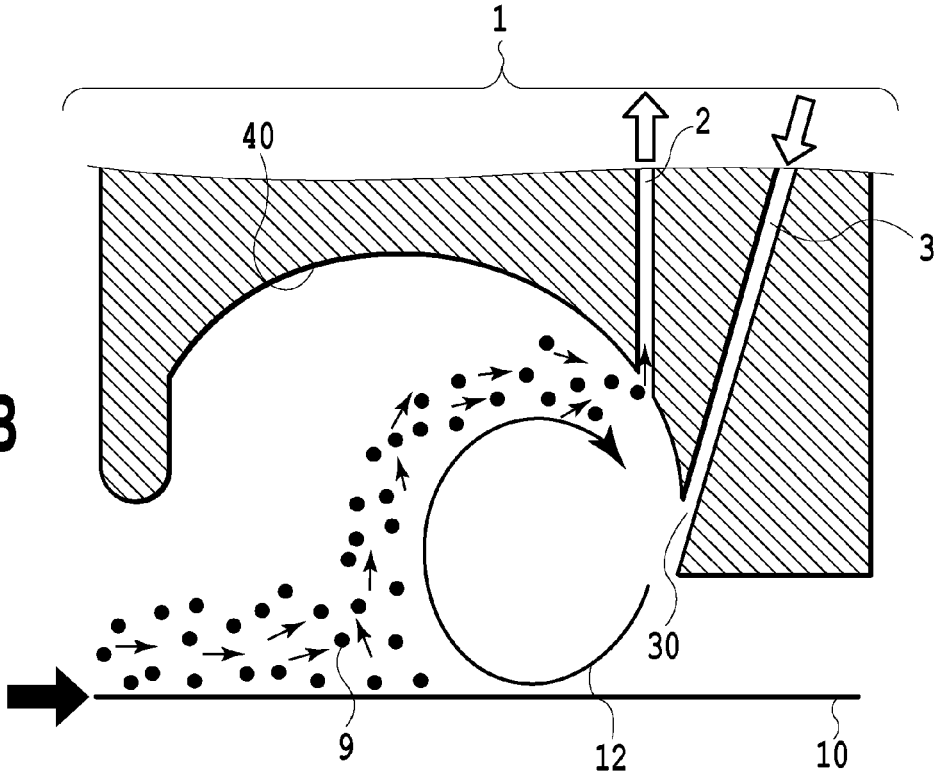
FIG. 8B is another cross-sectional view showing the mist recovering mechanism.

FIGS. 8A and 8B are cross-sectional views showing a mist recovering mechanism 1 in the present embodiment. The configuration of the present embodiment is identical to that of the third embodiment except that the position of a suction port 20 of a mist recovering unit 2 is varied. In FIG. 8A, the suction port 20 is formed at the center in a movement direction along the arc of an arcuate ceiling surface 40; and in FIG. 8B, the suction port 20 is formed in the vicinity of a gas blowing port 30 inside of a recess 4. It is confirmed that even in a case where the position of the suction port 20 of the mist recovering unit 2 is varied, like the present embodiment, a vortex 12 can be efficiently formed so as to recover mist 9.

Particularly, the suction port 20 is positioned nearer the gas blowing port 30 than the center of the recess 4, so that the vortex 12 formed through the gas blowing port 30 flows in an almost ideal circle, thus efficiently recovering the mist 9. In order to more stably recover the mist with higher efficiency, it is preferable that the mist recovering unit should be positioned nearer the gas blowing port 30 than the center of the recess 4. Here, the suction port 20 of the mist recovering unit 2 is only required to be disposed inside of the recess 4, thus securing a space for forming the vortex 12. Therefore, no problem arises in recovering the mist 9.

As described above, the curved ceiling surface is formed between the mist recovering unit (i.e., the suction port) and the gas blowing unit in the mist recovering mechanism, thus forming the recess. Furthermore, the suction port is formed at the center in the movement direction along the arc of the arcuate ceiling surface or in the vicinity of the gas blowing port (nearer the blowing port than the center). As a consequence, it is possible to achieve the liquid ejecting apparatus and the liquid ejecting head in which the mist does not close the ejection port so as to prevent any degradation of the reliability of the ejection.

Sixth Embodiment

A sixth embodiment according to the present invention will be described below with reference to the attached drawings. The basic configuration of the present embodiment is the same as that of the first embodiment, and therefore, only a characteristic configuration will be explained below.

Figure 9:
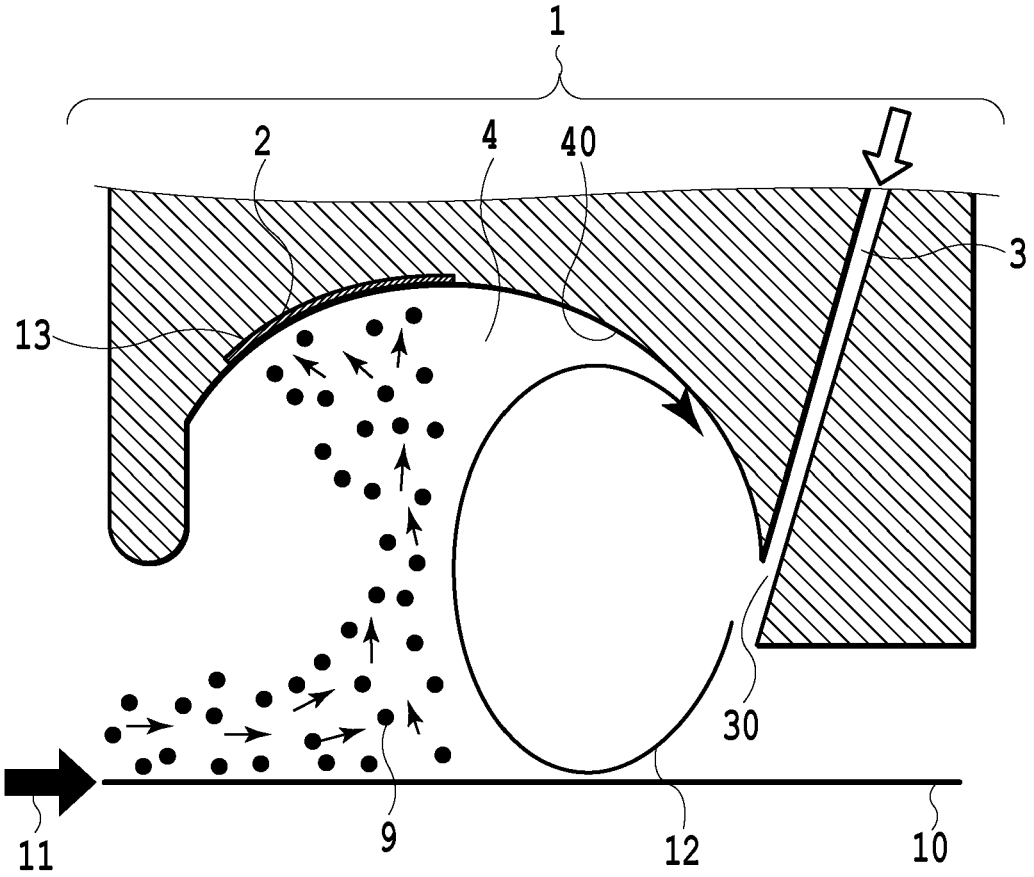
FIG. 9 is a cross-sectional view showing a mist recovering mechanism.

FIG. 9 is a cross-sectional view showing a mist recovering mechanism in the present embodiment. An electrode 13 is used as a mist recovering unit 2 in the present embodiment. It is known that mist 9 floating inside of a recess 4 is generally charged with negative electric charges. In view of this, an electrode having a positive electric field, for example, serving as the mist recovering unit 2 is disposed, so that the mist 9 swirled from a medium 10 on an airflow blowing through a gas blowing port 30 is attracted by the static electricity of the electrode 13, to be thus recovered.

According to the situation of electric charges of the floating mist 9, the electrode 13 may have a negative electric field or an electrode having a positive electric field and an electrode having a negative electric field may be arranged alternately.

Although the first to fifth embodiments have been described by way of the example in which a system for sucking the airflow under a negative pressure is used as the mist recovering unit, the system may be replaced with the electrode 13 as the mist recovering unit 2, like the present embodiment.

As described above, the curved ceiling surface is formed between the mist recovering unit and the gas blowing unit in the mist recovering mechanism, thus forming the recess, and then, the electrode serving as the mist recovering unit is disposed inside of the recess. As a consequence, it is possible to achieve the liquid ejecting apparatus and the liquid ejecting head in which the mist does not close the ejection port so as to prevent any degradation of the reliability of the ejection.

Seventh Embodiment

A seventh embodiment according to the present invention will be described below with reference to the attached drawings. The basic configuration of the present embodiment is the same as that of the first embodiment, and therefore, only a characteristic configuration will be explained below.

Figure 10:
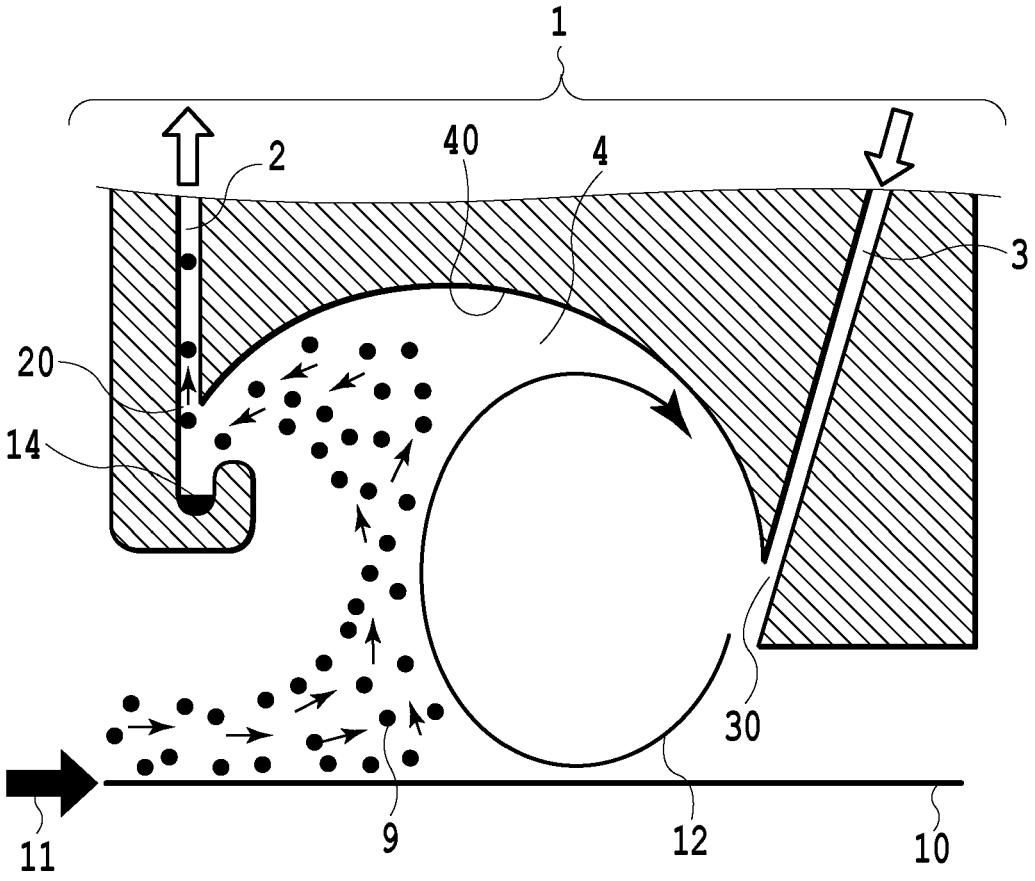
FIG. 10 is a cross-sectional view showing a mist recovering mechanism.

FIG. 10 is a cross-sectional view showing a mist recovering mechanism 1 in the present embodiment. In the mist recovering mechanism 1 in the present embodiment, a receiving portion 14 for receiving liquid therein so as to prevent any dropping of the liquid is formed under in a vertical direction of a mist recovering unit 2. Mist 9 sucked by the mist recovering unit 2 is designed to be recovered inside of the mist recovering unit 2. At this time, a part of the mist 9 adheres onto the inside wall of the mist recovering unit 2. The adhering mist 9 drops downward, thereby raising a drawback that the mist 9 drops on a medium 10.

In view of the above, the receiving portion 14 for receiving therein liquid that cannot be sufficiently recovered into the mist recovering unit so as to drop is formed right under the mist recovering unit 2 in the present embodiment. In this manner, even in a case where the mist 9 adhering onto the inside wall of the mist recovering unit drops downward, the mist 9 remains in the receiving portion 14, and thus, it does not drop on the medium 10.

As described above, the curved ceiling surface is formed between the mist recovering unit and the gas blowing unit in the mist recovering mechanism, thus forming the recess, and then, the receiving portion for receiving the liquid therein so as to prevent any dropping of the liquid is formed right under the mist recovering unit. As a consequence, it is possible to achieve the liquid ejecting apparatus and the liquid ejecting head in which the mist does not close the ejection port so as to prevent any degradation of the reliability of the ejection.

Eighth Embodiment

An eighth embodiment according to the present invention will be described below with reference to the attached drawings. The basic configuration of the present embodiment is the same as that of the first embodiment, and therefore, only a characteristic configuration will be explained below.

Figure 11A:
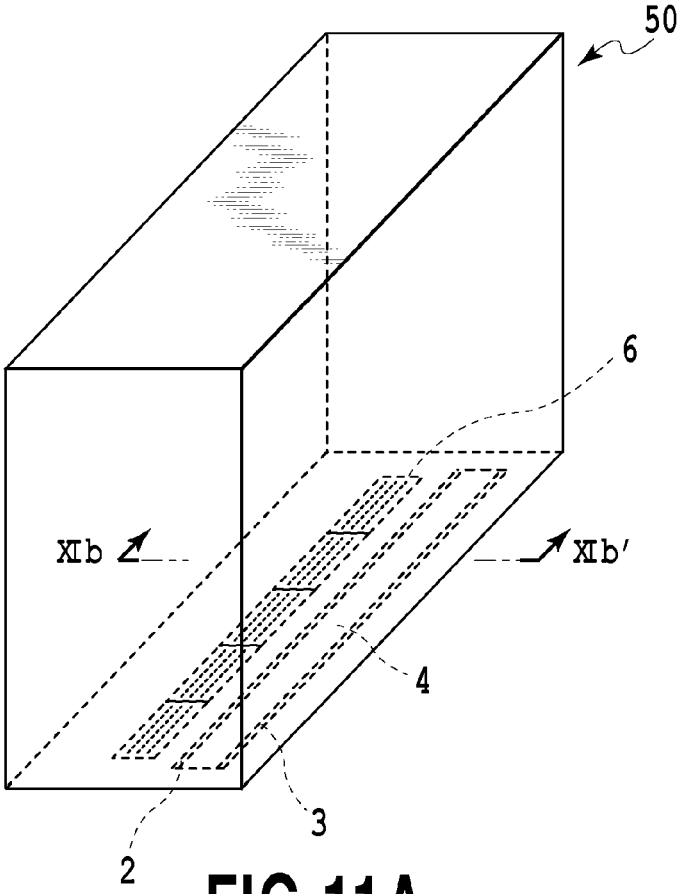
FIG. 11A is a schematic view showing a liquid ejecting head integrated with a mist recovering mechanism.
Figure 11B:
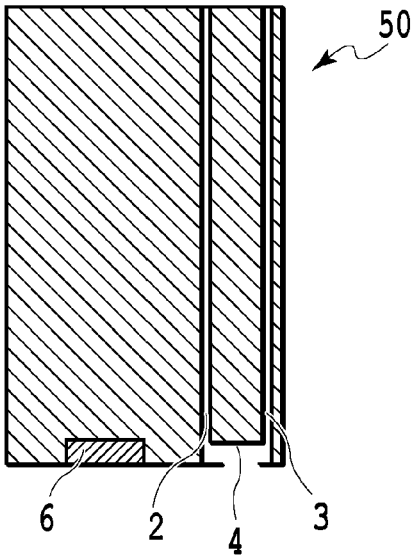
FIG. 11B is another schematic view showing the liquid ejecting head integrated with the mist recovering mechanism.

FIGS. 11A and 11B are schematic views showing a liquid ejecting head in which a mist recovering unit, a gas blowing unit, and a recess are integrated with each other in the present embodiment: where FIG. 11A is a perspective view showing the liquid ejecting head; and FIG. 11B is a cross-sectional view taken along a line XIb-XIb' of FIG. 11A.

The present embodiment is configured such that a liquid ejecting head 50 is provided with a mist recovering mechanism. The liquid ejecting head 50 and the mist recovering mechanism are not necessarily provided independently of each other. As shown in FIGS. 11A and 11B, the mist recovering mechanism may be included inside of the liquid ejecting head 50.

Figure 12:
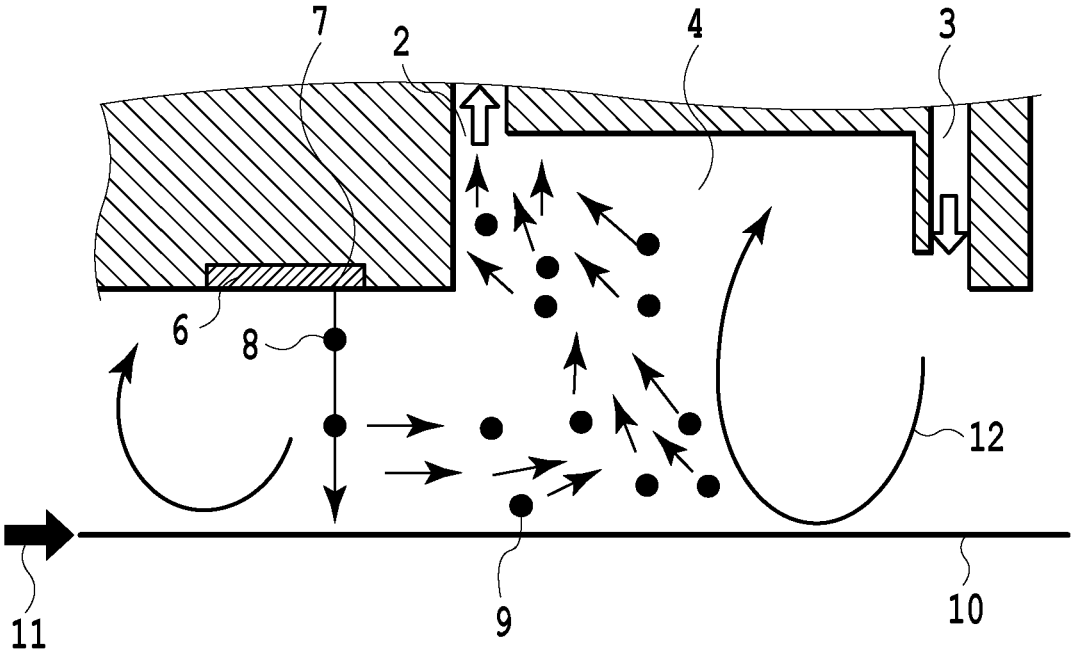
FIG. 12 is a schematic cross-sectional view showing the liquid ejecting head.

FIG. 12 is a schematic cross-sectional view showing the liquid ejecting head in the present embodiment. Mist 9 generated through an ejection port 7 flows downstream in a medium movement direction on an airflow produced by a relative movement between the liquid ejecting head 50 and a medium 10, and then, the mist 9 is swirled from the surface of the medium owing to a vortex 12 formed by blowing gas. Thereafter, the swirled mist 9 is recovered by a mist recovering unit 2.

As described above, the mist recovering mechanism is integrated with the liquid ejecting head, and furthermore, the ceiling surface is formed between the mist recovering unit and the gas blowing unit in the mist recovering mechanism, thus forming a recess. As a consequence, it is possible to achieve the liquid ejecting apparatus and the liquid ejecting head in which the mist does not close the ejection port so as to prevent any degradation of the reliability of the ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-056212, filed Mar. 19, 2015, which is hereby incorporated by reference wherein in its entirety.

What is claimed is:

1. A liquid ejecting apparatus including an ejecting unit configured to eject liquid to a medium through an ejection port and a moving unit configured to make a relative movement between the ejecting unit and the medium, the liquid ejecting apparatus comprising:

a recovering unit that is disposed downstream of the ejecting unit with respect to the relative movement of the medium and at a position at which the recovering unit can face the medium, the recovering unit being capable of recovering mist generated together with a main droplet of liquid ejected by the ejecting unit, the recovering unit including: a recovering portion disposed upstream with respect to the relative movement of the medium so as to recover the mist; and a blowing port that is disposed downstream of the relative movement of the medium with respect to the recovering portion and can blow gas, wherein at the recovering unit, a recess having a ceiling surface capable of facing the medium is formed between the recovering portion and the blowing port at a distance longer than a distance between an ejection port surface and the medium in a case where the ejection port surface of the ejection port of the ejecting unit faces the medium, and the recovering portion and the blowing port are disposed inside of the recess.

2. The liquid ejecting apparatus according to claim 1, wherein the blowing port is disposed at a position where the blowing port can face the medium.

3. The liquid ejecting apparatus according to claim 2, wherein the blowing port can face the medium at a distance shorter than a distance between the medium and the ceiling surface.

4. The liquid ejecting apparatus according to claim 1, wherein the ceiling surface is formed into an arcuate curve.

5. The liquid ejecting apparatus according to claim 1, wherein the blowing port can blow gas slantwise toward the medium and upstream with respect to the relative movement of the medium.

6. The liquid ejecting apparatus according to claim 5, wherein an angle at which gas is blown through the blowing port is 45° or more with respect to the medium.

7. The liquid ejecting apparatus according to claim 1, wherein the recovering portion is a suction port configured to suck and recover the mist under a negative pressure.

8. The liquid ejecting apparatus according to claim 1, wherein the recovering portion is provided with an electrode configured to recover the mist by static electricity.

9. The liquid ejecting apparatus according to claim 1, wherein the recovering portion is provided with a suction port configured to suck and recover the mist, and furthermore, includes a receiving portion configured to receive liquid in the receiving portion under in a vertical direction of the suction port.

10. The liquid ejecting apparatus according to claim 4, wherein the recovering portion is disposed at the center of the ceiling surface in a movement direction along an arc of the arcuate curve.

11. The liquid ejecting apparatus according to claim 4, wherein the recovering portion is disposed nearer the blowing port than the center of the ceiling surface in a movement direction along an arc of the arcuate curve.

12. A liquid ejecting head configured to eject liquid through an ejection port to a medium that makes a relative movement, the liquid ejecting head comprising:

a recovering unit capable of recovering mist generated together with a main droplet of liquid to be ejected downstream with respect to the relative movement of the medium and at a position that the recovering unit can face the medium, the recovering unit including: a recovering portion disposed upstream with respect to the relative movement of the medium so as to recover the mist; and a blowing port that is disposed downstream of the relative movement of the medium with respect to the recovering portion and can blow gas, wherein at the recovering unit, a recess having a ceiling surface capable of facing the medium is formed between the recovering portion and the blowing port at a distance longer than a distance between an ejection port surface and the medium in a case where the ejection port surface having the ejection port of the liquid ejecting head faces the medium, and the recovering portion and the blowing port are disposed inside of the recess.

13. The liquid ejecting head according to claim 12, wherein the blowing port is disposed at a position at which the blowing port can face the medium.

14. The liquid ejecting head according to claim 13, the blowing port can face the medium at a distance shorter than that between the medium and the ceiling surface.

15. The liquid ejecting head according to claim 12, wherein the ceiling surface is formed into an arcuate curve.

16. The liquid ejecting head according to claim 12, wherein the blowing port can slantwise blow gas toward the medium upstream with respect to the relative movement of the medium.

17. The liquid ejecting head according to claim 16, wherein an angle at which gas is blown through the blowing port is 45° or more with respect to the medium.

18. The liquid ejecting head according to claim 12, wherein the recovering portion is a suction port configured to suck and recover the mist under a negative pressure.

19. The liquid ejecting head according to claim 15, wherein the recovering portion is disposed at the center of the ceiling surface in a movement direction along an arc of the arcuate curve.

20. The liquid ejecting head according to claim 15, wherein the recovering portion is disposed nearer the blowing port than the center of the ceiling surface in a movement direction along an arc of the arcuate curve.

* * * * *